United States Patent [19]

Ara

[11] Patent Number: 4,697,939

[45] Date of Patent: Oct. 6, 1987

[54] WIRE DOT PRINTER WITH IMPROVED WIRE DOT HEAD

[75] Inventor: Yoji Ara, Kawasaki, Japan

[73] Assignee: Canon Kabushiki Kaisha, Tokyo, Japan

[21] Appl. No.: 822,953

[22] Filed: Jan. 27, 1986

Related U.S. Application Data

[63] Continuation of Ser. No. 531,336, Sep. 12, 1983, abandoned.

[30] Foreign Application Priority Data

| | | | |
|---|---|---|---|
| Sep. 17, 1982 | [JP] | Japan | 57-160930 |
| Sep. 30, 1982 | [JP] | Japan | 57-169837 |
| Sep. 30, 1982 | [JP] | Japan | 57-169838 |
| Sep. 30, 1982 | [JP] | Japan | 57-169839 |

[51] Int. Cl.[4] ..... B41J 3/12

[52] U.S. Cl. ..... 400/124; 101/93.05; 400/686; 400/719; 335/271; 335/277

[58] Field of Search ..... 400/124, 686, 689, 694, 400/719; 101/93.05; 335/271, 277

[56] References Cited

U.S. PATENT DOCUMENTS

| | | | |
|---|---|---|---|
| 3,770,092 | 11/1973 | Grim | 400/124 |
| 3,897,865 | 8/1975 | Darwin | 400/124 |
| 4,009,772 | 3/1977 | Glaser et al. | 400/124 |
| 4,140,406 | 2/1979 | Wolf et al. | 101/93.05 X |
| 4,260,270 | 4/1981 | Cavallari | 400/124 |
| 4,279,525 | 7/1981 | Johnston | 400/124 X |
| 4,375,338 | 3/1983 | Mitsuishi | 400/124 |
| 4,411,538 | 10/1983 | Asano | 400/124 |
| 4,441,828 | 4/1984 | Ochiai et al. | 400/124 |

FOREIGN PATENT DOCUMENTS

| | | | |
|---|---|---|---|
| 86772 | 6/1980 | Japan | 400/124 |
| 22072 | 2/1982 | Japan | 400/719 |

OTHER PUBLICATIONS

*The Condensed Chemical Dictionary*, Sixth Edition, Reinhold Publishing Corporation, New York, 1961, p. 919.

*Primary Examiner*—Paul T. Sewell

*Attorney, Agent, or Firm*—Fitzpatrick, Cella, Harper & Scinto

[57] ABSTRACT

A wire dot printer has a wire dot head comprising a plurality of electromagnets for attracting each armature to thereby project each wire to a printing position, a first cover provided with a guide for guiding the wires to the printing position, holding means for holding the electromagnets, the holding means being formed of a material of high heat radiation efficiency, and a second cover connected to the holding means with high heat conducting efficiency and covering the electromagnets and the armatures, the second cover being provided with radiation fins at a plurality of locations thereon.

3 Claims, 11 Drawing Figures

WIRE DOT PRINTER WITH IMPROVED WIRE DOT HEAD

This application is a continuation of application Ser. No. 531,336, filed Sept. 12, 1983, now abandoned.

BACKGROUND OF THE INVENTION

1. Field of the Invention

This invention relates to a wire dot printer in which wires are selectively projected by a plurality of electromagnets to effect printing (including recording).

2. Description of the Prior Art

When it is desired to form a character by a dot matrix, if it is assumed that an m×n dot matrix is disposed as shown in FIG. 1 of the accompanying drawings, use is made of a printing head comprising n wires arranged in a row at a pitch $P_2$ in the longitudinal direction and, if this printing head is shifted to right or left m times at a pitch $P_1$ and the wires are designed so as to be capable of being driven for each pitch, there can be formed m×n dot matrices.

Generally, a wire dot head is such that an armature is attracted and operated by an electromagnet contained in the head body and a wire is urged against printing paper by the armature through an ink ribbon, whereby desired printing is effected by the aforementioned dot matrices. When the armature is attracted and operated, heat is generated by excitation of the coil of the electromagnet and therefore, the head body heats. Accordingly, exciting current is decreased by the increase in coil resistance caused by this heating and the force which electromagnetically attracts the armature is reduced and the operation efficiency of the armature is reduced. Therefore, the urging drive force, i.e., the printing pressure, of the wire connected to the armature becomes small, thus resulting in a reduced quality of printing. Also, the surface temperature of the head rises to the order of 90° C., and this is very dangerous to the operator.

Also, a wire dot printer effects printing by impact and this leads to the advantage that several copies can be produced at a time, but as a disadvantage thereof, noise is great. Accordingly, such noise has limited the use of conventional wire dot printers in offices. There are two causes of the sound produced when printing is effected by the use of such a wire dot printer. A first cause is the impact sound produced when dots are printed on printing paper. The quality of such impact sound is determined by the material and hardness of the platen, the mounted condition of the printing paper and the printing force of the wire. A second cause is the stop sound produced when the armature to which the wire is connected is stopped by a stopper in the course of its return to the original position after completion of printing.

In the wire dot printer, not only noise produced by such collision of the wire, but also the operation of the armature becomes unstable due to the creation of rebound of the armature, and this has led to the shortcoming that the quality of printing is deteriorated.

Thus, the conventional wire dot printers have not always been sufficient in the operation efficiency of the armature.

SUMMARY OF THE INVENTION

It is an object of the present invention to provide a wire dot printer of high operation efficiency.

It is another object of the present invention to enhance the radiation efficiency of heat generated from electromagnets.

It is still another object to facilitate the assembly of a wire dot head.

It is yet still another object of the present invention to reduce the noise level.

It is a further object of the present invention to effectively effect the radiation from radiation fins by utilizing the movement of the wire dot head in the printing direction.

It is still a further object of the present invention to stabilize the operation of armatures.

It is yet still a further object of the present invention to reduce the number of parts.

It is a further object of the present invention to eliminate the rebound of the armatures.

Other objects will become apparent from the following detailed description taken in conjunction with the accompanying drawings.

DESCRIPTION OF THE PREFERRED EMBODIMENTS

Figure 1:
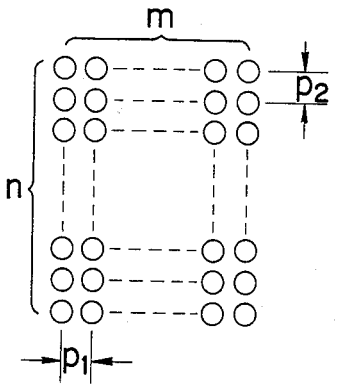
FIG. 1 is a plan view showing the construction of dot matrices.
Figure 2:
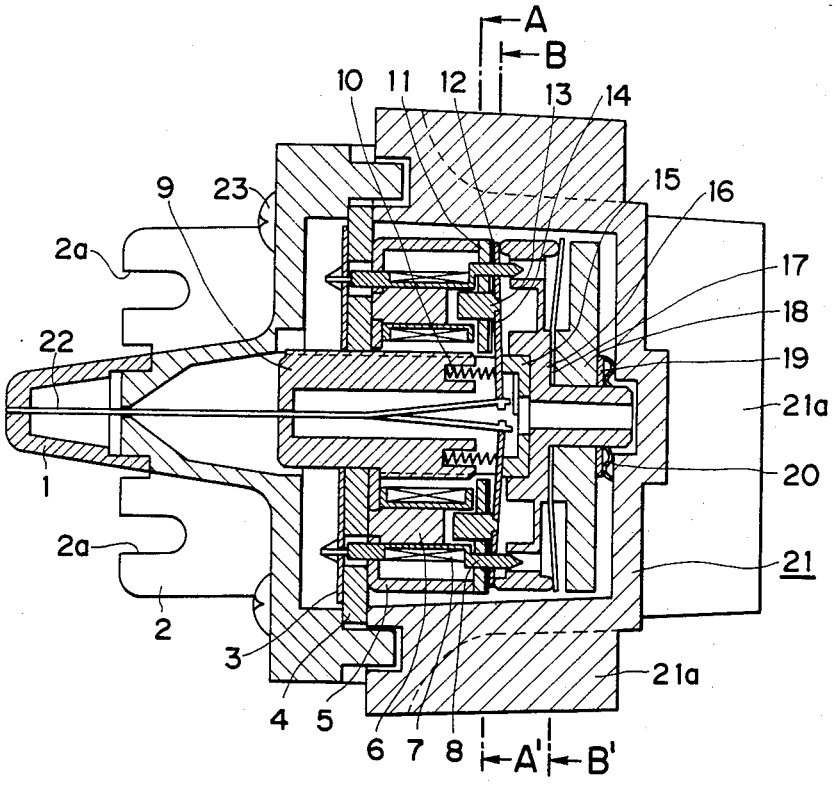
FIG. 2 is a longitudinal cross-sectional view showing an embodiment of the wire dot head according to the present invention.
Figure 3:
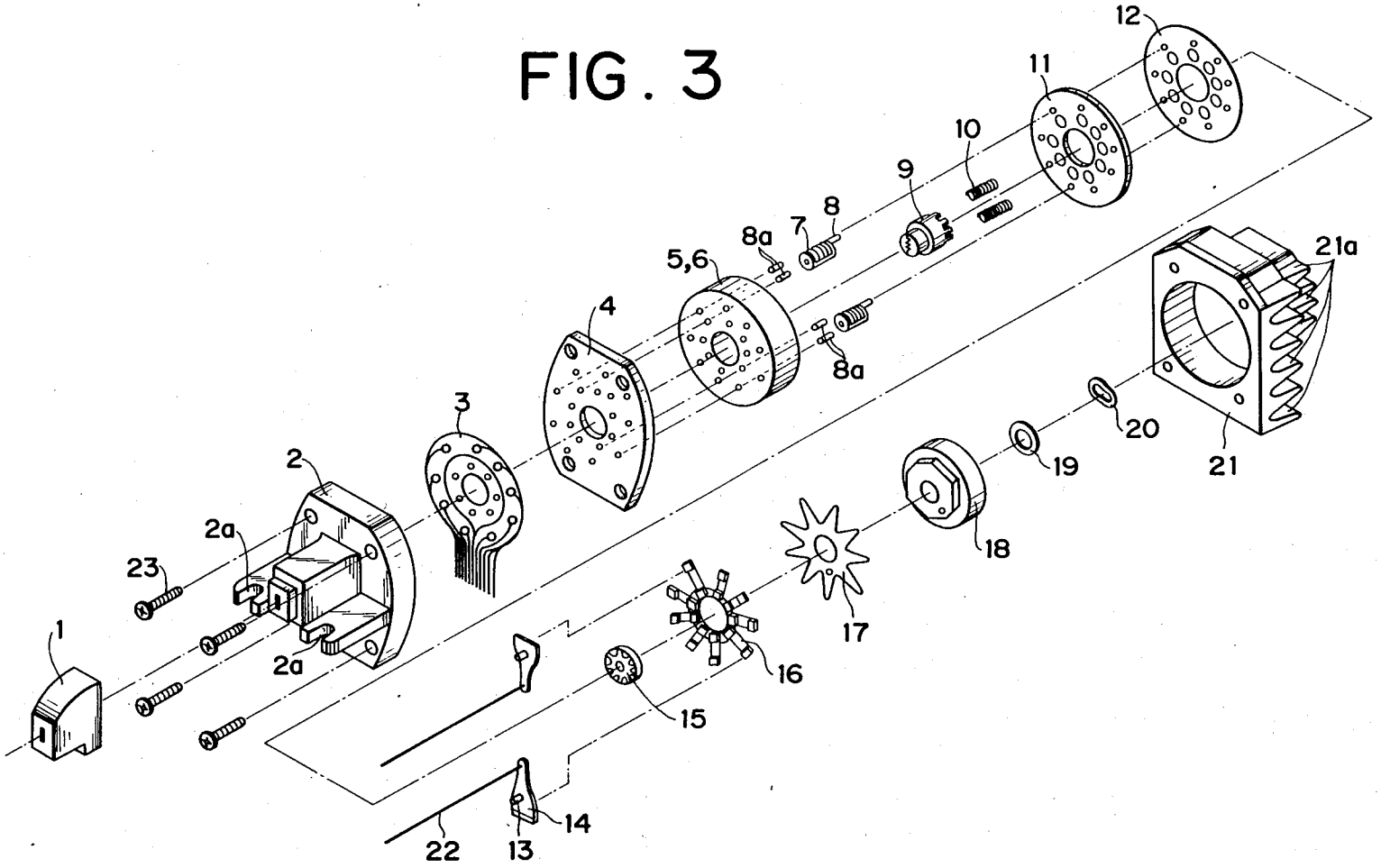
FIG. 3 is an exploded perspective view of the essential portions of the wire dot head shown in FIG. 2.
Figure 4:
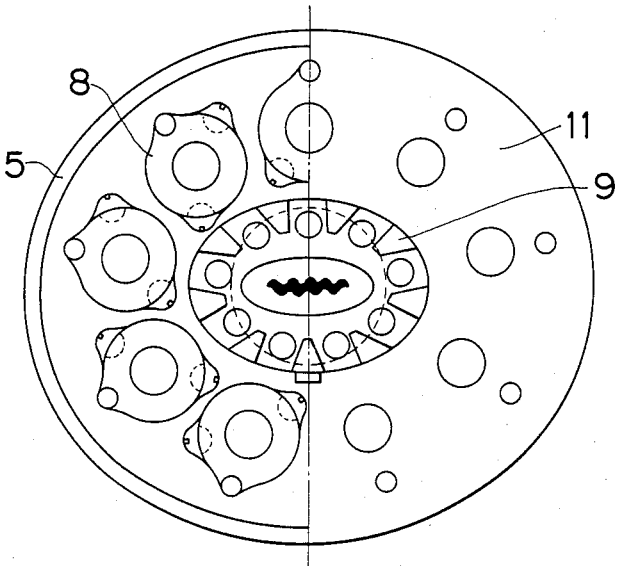
FIG. 4 is a view taken along line A—A' of FIG. 2.

FIG. 2 is a longitudinal cross-sectional view of a wire dot head used in a wire dot printer in accordance with the present invention, and FIG. 3 is an exploded perspective view of the essential portions thereof. In these Figures, reference numeral 1 designates a tip end guide for facilitating the assembly of a wire 22 to the head body, and reference numeral 2 denotes an intermediate guide mounted on a back holder (to be described) by screws 23 through a mating portion for positioning, not shown, and serving also as a cover for covering the forward portion of an internal electromagnet. The intermediate guide 2 is formed with grooves 2*a* for screws for attaching it to a carriage, not shown, and is U-shaped for the ease of mounting and dismounting of the head. Reference numeral 3 designates a flexible cable for supplying a current to the coil of an electromagnet to be described, and reference numeral 4 denotes a radiator plate formed of a material of good heat conductivity such as aluminum, the radiator plate 4 making surface contact with the yoke of an electromagnet to be described and a back holder to be described and serving also as a spacer between the aforementioned flexible cable 3 and the yoke. In the present embodiment, the thickness of the radiator plate 4 is about 2 mm to enable the heat of the yoke to be sufficiently conducted to the back holder, and the material of the radiator plate is preferably aluminum or magnesium which has good heat conductivity. In the present embodiment, aluminum is employed as the material of the radiator plate. Reference numeral 5 designates the yoke of the electromagnet. The yoke 5 is formed into an elliptical shape as shown in FIG. 4 and is designed to unify the sliding resistance of the wire and prevent the density irregularity between dots formed on printing paper. Designated by 6 is a core coupled to the yoke 5. A bobbin 8 having a coil 7 wound thereon is fitted on the core 6. The bobbin 8 is provided with two terminals 8*a*. The beginning end and the terminal end of the coil 7 are soldered to the two terminals 8*a*, which is turn are soldered to the aforementioned flexible cable 3 to permit the supply of power to the coil 7. Reference numeral 9 denotes a rear guide positioned at the center of the head body and contained in the yoke 5. One end of a restitution spring 10 for returning an armature 14 to its initial position after it is driven is secured to the rear guide 9. The armature 14 is attracted to print dots by the wire 22, whereafter it is returned to its initial position by the restitution spring 10 and a stopper 15. The restitution spring 10 and the stopper 15 are aligned with each other so that the movement of the armature 14 is stable. That is, the strength of the restitution spring 10 and the hardness of the stopper 15 are determined so that stable movement of the armature 14 is possible and, in the present embodiment, polyurethane or the like is employed as the material of the stopper 15.

Figure 5:
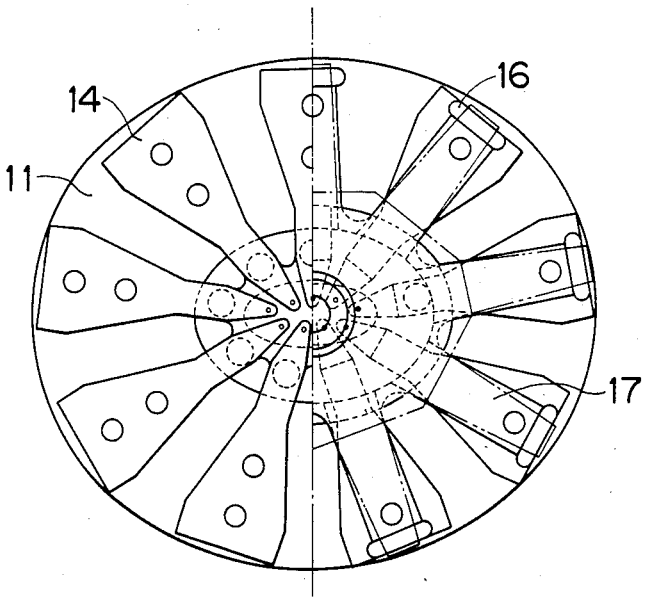
FIG. 5 is a view-taken along line B—B' of FIG. 2.

Reference numeral 11 designates an auxiliary yoke juxtaposed with the yoke 5, and reference numeral 12 denotes a spacer of polyester film or the like interposed between the auxiliary yoke 11 and the armature 14 to prevent the instability of the movement of armature 14 based on the abrasion resulting from the rotation caused by the line contact with the auxiliary yoke 11 and the residual magnetism of the auxiliary yoke 11 which offers a problem during the formation of a closed magnetic circuit. Designated by 13 is a plunger secured to the armature 14. A wire 22 is coupled to one end of the armature 14 by brazing. An aperture, not shown, in which the mating portion of the bobbin 8 is fitted is provided at the other end of the armature 14, and the armature 14 is pivotable with this mating portion as the fulcrum. Denoted by 16 is an armature holder which holds the pivot portion of the armature 14 from the rear thereof during the pivotal movement of the armature to thereby achieve the stabilization of the pivotal movement of the armature 14. The aforementioned stopper 15 is fitted to the armature holder 16. Reference numeral 17 designates a plate spring provided in contact with the armature holder 16, and the armature holder 16 is uniformly urged by resilient displacement of this plate spring 17. The arrangement relation of the auxiliary yoke 11, armature 14, armature holder 16 and plate spring 17 is shown in FIG. 5. Reference numeral 18 denotes a damper provided on the plate spring 17. This damper 18 is urged and held by a back holder 21 formed of a material having high heat conductivity such as aluminum and functioning as an extraneous radiator member, through a washer 19 and a spring washer 20. The back holder 21 is of a shape which serves also as a cover for covering the rear of an internal electromagnet and which has a plurality of planar fins 21*a* integral with one another to enhance the radiation effect. These fins 21*a*, as clearly shown in FIGS. 2 and 3, are formed so that their lengthwise direction is a direction substantially perpendicularly intersecting the direction of arrangement of the wire 22 arranged substantially rectilinearly in the longitudinal direction from the center thereof to the fore end thereof. This is because the wire dot head is fixed to a carriage so that each end of the wire 22 is arranged in a direction substantially orthogonal to the direction of movement of the carriage when the wire dot head is mounted on the carriage and effects printing, and also because if these radiation fins are arranged lengthwisely in a direction orthogonal to the direction of arrangement of the wire 22, namely, a direction substantially parallel to the direction of movement of the carriage, the radiation effect of the fins is very effectively provided by movement of the carriage. Also, the back holder 21 and the intermediate guide 2 have no unnecessary openings so that the interior thereof is substantially hermetically sealed when they are fitted and fixed by screws 23 at the opposite sides and internal noise cannot escape directly.

On the other hand, the damper 18 is designed to further enhance its anti-vibration effect by being pivotably provided by the plate spring 17 and the spring washer 20. Also, the washer 19 prevents the spring washer 20 from abrading the damper 18. The wire 22 is designed to be supported by the guide 1, 2 and 9 for the ease of the assembly thereof, to reduce the drag from each guide, to decrease the sliding resistance of the wire 22 and to improve the efficiency of converting electrical energy into printing energy.

When power is supplied to the coil 7 of the head of the above-described construction through the flexible cable 3, a closed magnetic circuit is formed by the yoke 5, auxiliary yoke 11, plunger 13 and core 6 and therefore, the plunger 13 is attracted to the core 6 with a result that the wire 22 coupled to the armature 14 is pushed out and dots are formed on printing paper through an ink ribbon, not shown. As previously described, however, the coil 7 heats due to the resistance of the coil 7 itself and the generation of an eddy current in the core 6 and the attraction is decreased by the decrease in exciting current resulting from an increase in resistance of the coil 7 itself and this may result in reduced quality of printing. In this case, according to the experiment, the heat-resisting temperature of the coating of the coil 7 is about 120° C. and the heat-resisting temperature of the bobbin 8 is about 150° C. and therefore, after all, the temperature of the solenoid portion must be maintained below 120° C. To this end, a mechanism for enhancing the efficiency of converting electrical energy into printing energy and enhancing the radiation of the heat generated must be provided. As the countermeasure for the former, means may be provided which will enhance the magnetic efficiency of the magnetic circuit and moreover minimize the sliding resistance of the wire 22, and as the countermeasure for the latter, means may be provided which will enhance the radiation of heat.

Figure 6:
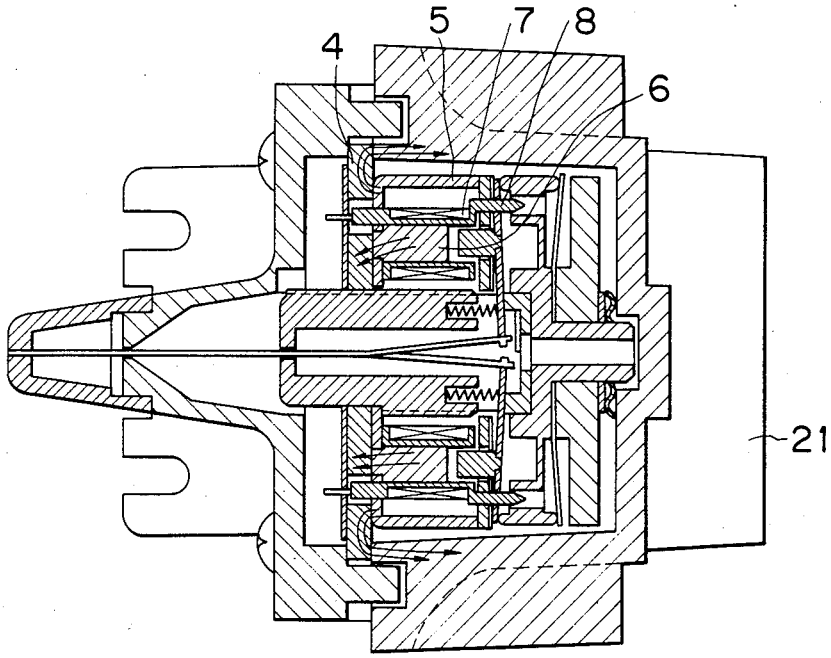
FIG. 6 is a partly cross-sectional view for explaining the conduction of heat from an electromagnet in the embodiment shown in FIG. 2.

According to the present embodiment, as will be seen from the radiation path of heat from the electromagnet of FIG. 6, the heat generated in the coil 7 and core 6 is collected into the yoke 5 to which the core 6 is coupled from each solenoid portion constituting the electromagnet, and the yoke 5 in heating condition is in intimate contact with the radiator plate 4 and therefore, the heat thereof is efficiently conducted to the radiator plate 4. The heat thus conducted to the radiator plate 4 is further conducted to the back holder 21 through the portion which is in intimate contact with the back holder 21 and which functions as the aforementioned external radiator member.

According to an embodiment of the present invention, the heat from the coil 7 and core 6 is efficiently radiated through the back holder 21 and moreover, this back holder is very excellent in radiation efficiency and thus, reduction in printing force does not occur and high quality of printing can be maintained even if printing is effected for a long time. Also, by reduction of the temperature of the wire dot head by about 20° C. can be achieved by this radiator mechanism and safe printing operation becomes possible.

The damper 18 will now be described in detail.

Figure 7:
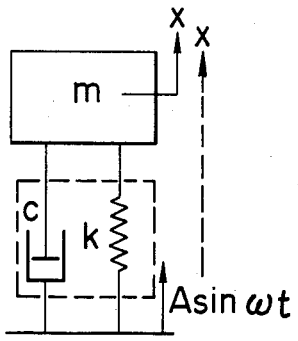
FIG. 7 schematically illustrates a vibration system.

The armature 14 after having completed the printing of each dot is moved to its initial position by the restitution spring 10 and stopped thereat by bearing against the stopper 15. This stopper 15 is made of rubber and therefore, the shock vibration caused when the armature 14 is stopped is transmitted to the armature holder 16 through the stopper 15. The shock vibration transmitted to the armature holder 16 is further transmitted to the plate spring 17 and the damper 18. The vibration system in this case is schematically shown in FIG. 7, wherein m is the mass of the damper 18, x is the displacement of the damper 18, c and k are the viscosity attenuation coefficient and the spring constant, respectively, of this vibration system. The dotted line box represents the stopper 15. If the displacement thereof is $u=A \sin \omega t$ and the frequency of the armature 14 is f, $$f=(\omega/2\pi) \quad (1),$$

where $\omega$ is called the angular frequency. In the case of the present embodiment, the frequency of the armature is f=800 (Hz).

If the displacement of the damper 18 is x when forcible displacement u acts on the stopper 15, the displacement of the spring and of the attenuator is equal to the relative displacement (x−u) between the damper 18 and the stopper 15. Accordingly, the movement equation of the vibration system is:

$$m\ddot{x}=-c(\dot{x}-\dot{u})-k(x-u) \quad (2)$$

$$m\ddot{x}+c\dot{x}+kx=c\dot{u}+ku \quad (3)$$

where, from $u=A \sin \omega t$, $$m\ddot{x}+c\dot{x}+kx=A(k \sin \omega t+c\omega \cos \omega t)=A\sqrt{k^2+(c\omega)^2} \sin (\omega t+\alpha) \quad (4),$$

where $\alpha$ is the phase angle and $$\alpha=\tan^{-1} (c\omega/k) \quad (5)$$

The steady vibration of the damper 18 is equal to the vibration caused when a harmonic vibromotive force indicated by $A\sqrt{k^2+(c\omega)^2} \sin (\omega t+\alpha)$ directly acts on the damper 18, and the amplitude thereof is $$X = A\sqrt{\frac{k^2+(c\omega)^2}{(k-m\omega^2)^2+(c\omega)^2}}. \quad (6)$$

Also, the ratio of the vibration of the damper 18 to the vibration of the stopper 15 is $$\frac{X}{A}=\sqrt{\frac{1+(2\zeta\,\omega/\omega)^2}{\{1-(\omega/\omega n)^2\}^2+(2\zeta\omega/\omega n)^2}}=T_R, \quad (7)$$

where $T_R$ is the transmission factor of displacement, and $\xi$ is the viscosity attenuation percentage and is expressed by $$\zeta=\frac{c}{2\sqrt{mk}}. \quad (8)$$

Also, $$\omega=\sqrt{\frac{k}{m}}. \quad (9)$$

Figure 8:
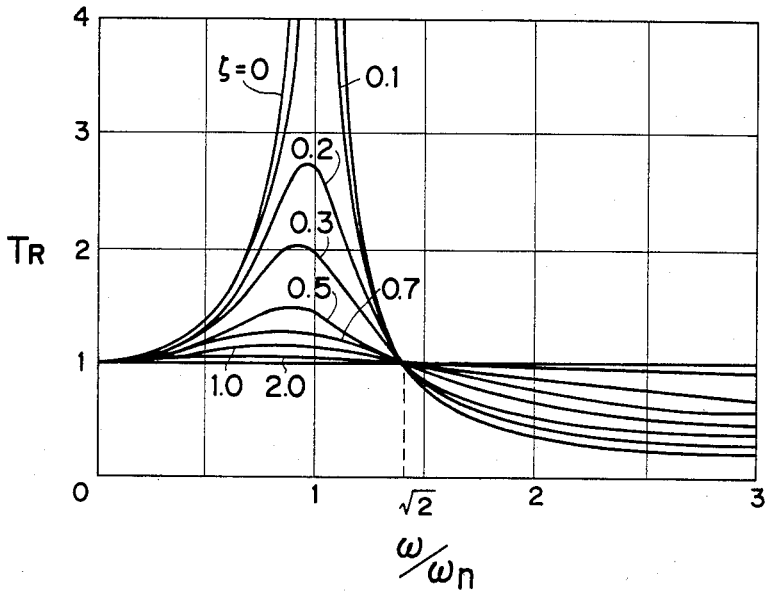
FIG. 8 is a characteristic graph showing the transmission factor of the displacement from a stopper to a damper.

FIG. 8 shows the magnitude of the transmission factor of displacement. As seen in FIG. 8, irrespective of the attenuation percentage $\xi$, $T_R>1$ when $\omega/\omega n>\sqrt{2}$, $T_R\leqq 1$ only when $\omega/\omega n\geqq 2$. Generally, the effect of vibration isolation is better as the natural frequency of the vibration system is smaller. That is, as can be seen from equation (9), either the mass of the damper 18 can be made great or the spring constant can be made small. To make the mass of the damper 18 great, use may be made of a material having a great specific gravity and, in the case of the head of the present embodiment, lead is used to make the mass great. On the other hand, to make the spring constant small, in the head of the present embodiment, the damper 18 is sandwiched between the plate spring 17 and the spring washer 20.

Thus, according to an embodiment of the present invention, as can be seen from equations (8) and (9) and FIG. 8, the material and the holding structure of the damper 18 are such that the transmission factor of displacement is made small and therefore, the stop sound produced when the armature 14 strikes against the stopper 15 can be weakened, and this leads to realization of a low noise wire dot head. By so using the damper 18, the plate spring 17 formed of stainless steel and the spring washer 20 around the stopper member for the armature, the stop sound of the armature 14 can be reduced and, according to the experiment, reduction of noise by about 10 dB can be achieved as compared with the conventional wire dot head.

The stopper 15 will now be described in detail.

When power is supplied to the coil 7 of the wire dot head of the above-described construction, a closed magnetic circuit is formed by the yoke 5, auxiliary yoke 11, plunger 13 and core 6 and therefore, the plunger 13 is attracted toward the core 6 and the armature 14 pivots so as to push out the wire 22 against the force of the restitution spring 10. At this time, the wire 22 prints dots on printing paper through an ink ribbon. At this moment of printing, the wire 22 restores its original position by the repulsing force from the platen and the armature 14 restores its original position by the force of the restitution spring 10 and bears against the stopper 15, thereby being stopped at its initial position. At this time, the armature 14 effects a subtle movement due to the stopper 15 and the restitution spring 10. That is, the material and hardness of the stopper 15 and the spring constant of the restitution spring 10 determine the movement of the armature 14. If the spring constant of the restitution spring 10 is great, the attraction is decreased and therefore the printing force is also reduced, but the armature 14 is easy to restore its initial position in a stable condition.

On the other hand, if the hardness of the stopper 15 is high, the armature 14 becomes liable to repel from the stopper 15. If the hardness of the stopper 15 is low, the armature 14 rebounds less from the stopper 15 and movement of the armature 14 becomes stable.

Figure 9:
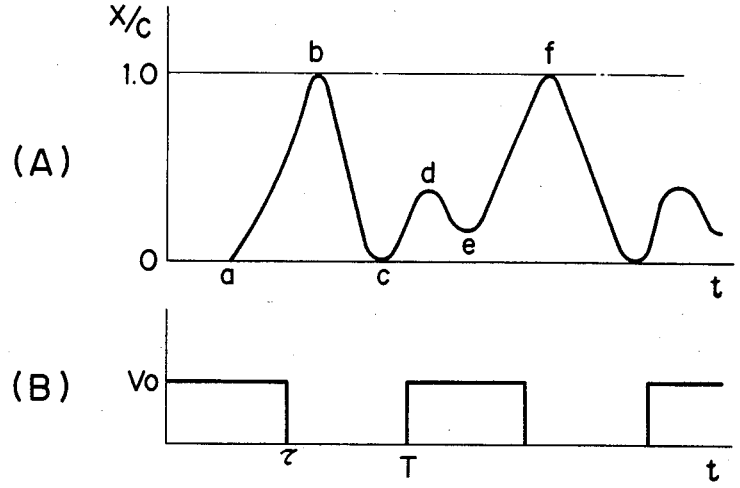
FIGS. 9(A) and (B) illustrate the operation of the armature when a conventional stopper is used.

The aforementioned state of unstable movement of the armature 14 is shown in FIGS. 9(A) and (B). FIG. 9(A) shows the relation between the displacement x of the end of the wire by defining the non-dimensional parameter x/c as x divided by the the clearance c between the end of the wire and the end of the printing head, and time, printing being effected at $x/c=1.0$. On the other hand, FIG. 9(B) shows the relation between transmission signal (voltage) and time. FIGS. 9(A) and 9(B) correspond to each other in respect of their time axes. That is, where the period of the signal is T and the power supply time is $\tau$, the wire 22 begins to move from a with a delay with respect to the signal and arrives at the surface of paper at b and effects printing, whereafter the wire 22 is returned to the position of the stopper 15 by the repulsing force from the platen and the force of the restitution spring 10. However, due to the inappropriate spring constant of the restitution spring 10 or the high hardness of the stopper 15, the wire 22 rebounds at c from the stopper 15 and moves to d. At this time, the wire 22 tries to return to its original position with the aid of the force of the restitution spring 10, but the next signal is supplied at e and therefore, the wire 22 tries to move toward the surface of paper and arrives at the surface of paper at f, thus printing dots. At this point e, the attraction toward the surface of paper is reduced by the inertia force of the wire 22 and therefore, the printing force is reduced at the printing point f and the printed dots become thin. Such unstable operation occurs even if the spring constant of the restitution spring 10 is set appropriately but if the hardness of the stopper 15 is high. In the conventional head, use has been made of a stopper 15 of plastics having a high hardness and therefore, movement of the wire 22 has become unstable and also great shock sound has been produced when the armature 14 bears against the stopper 15.

Figure 10:
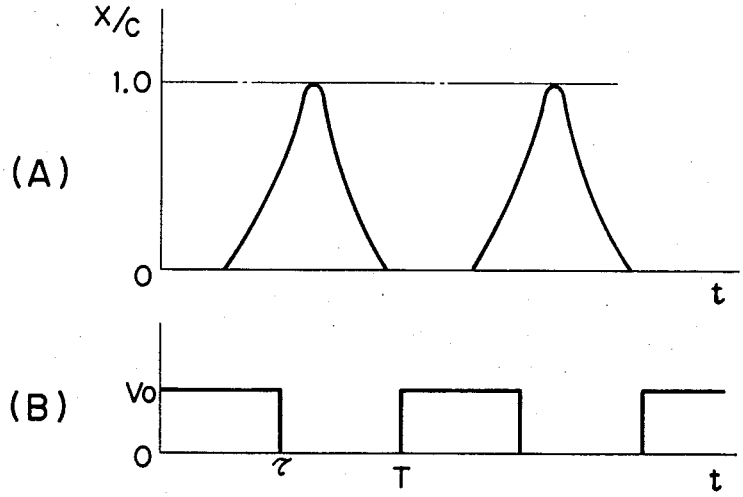
FIGS. 10(A) and (B) illustrate the operation of the armature when the stopper of the present invention is used.

In the present embodiment, the restitution spring 10 used is of an appropriate spring constant and made of polyurethane rubber. In the present embodiment, the hardness of the rubber is 94° C., and polyester and isocyanate are mixed with polyurethane rubber to improve the wearability of the restitution spring and prevent the first non-operation resulting from the intimate contact between the armature 14 and the stopper 15. The use of such resilient stopper 15 causes the stopper 15 to be displaced when the armature 14 bears against the stopper 15 and therefore, the vibration energy is absorbed and the sound produced is small. The resulting movement of the wire 22 for an electrical signal is shown in FIGS. 10(A) and (B). As will be seen from FIGS. 10(A) and (B), the wire 22 after printing quickly restores its original position and can maintain an operation corresponding to the electrical signal because no rebound is created by the resilient stopper 15.

An embodiment of the present invention has been described above. Since the member constituting the stopper 15 is formed of wear-proof polyurethance rubber, the shock absorbing property relative to the armature 14 is improved, and the unstable movement of the armature as shown in FIG. 9(A) is eliminated and therefore, the print density irregularity and pitch irregularity during printing are prevented and the quality of printing is remarkably improved. According to the experiment, reduction of noise by about 10 dB becomes possible as compared with a case where the conventional wire head is used.

Description will now be made of another embodiment, shown in FIG. 11, in which the stopper 15 and the armature holder 16 are made integral with each other.

To prevent the reduction of the quality of printing caused by the wear of the supporting portion of the armature holder 16 which supports the armature 14, the material of the armature holder 16 must be a wear-proof material. Accordingly, in the present embodiment, the material of the armature holder 16 is the same as the material of the stopper 15.

That is, in the present embodiment, use is made of a restitution spring 10 of an appropriate spring constant and the stopper 15 and the armature holder are formed integrally with each other and the material thereof is polyurethane rubber. This polyurethane rubber, like that in the previously described embodiment, has polyester and isocyanate mixed therewith.

The use of such stopper 15 and armature holder 16 which are made integral with each other results in not only the improved shock absorbing property of the stopper 15 relative to the armature 14, but also improved wearability of the armature holder 16, which in turn leads to unified urging force imparted to the armature 14 and accordingly to stabilized operation of the armature 14. Thus, the operation of the wire 22 also becomes stable and maintenance of a high quality of printing becomes possible.

Figure 11:
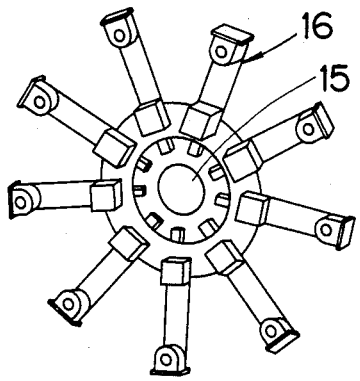
FIG. 11 is a perspective view of another embodiment in which the stopper and the armatures are made integral with each other.

Further, in addition to using a common material for the stopper 15 and the armature holder 16, making the stopper 15 and the armature holder 16 integral with each other as shown in FIG. 11 reduces the number of parts and improves the assembly efficiency.

In the present invention, the stopper 15 and the armature holder 16 may be made separate from each other and moreover, these two members may be formed of a material composed of chiefly polyurethane rubber having polyester and isocyanate mixed therewith.

What I claim is:

1. A wire dot printer having a wire dot head comprising:

a plurality of armatures provided correspondingly to a plurality of wires and held so as to be reciprocally pivotable about a fulcrum;

an electromagnet for attracting said armatures for pivotably moving said armatures and driving said wires;

a stopper formed of a material having elasticity for stopping said armatures when they pivot for return;

shock absorbing means for alleviating the shock with which said armatures strike against stopper, said shock absorbing means formed of a material having a greater specific gravity than that of the material of said stopper, and said shock absorbing means being resiliently urged by a spring member toward said stopper; and holding means for pivotably holding said plurality of armatures, said holding means being urged by said spring member to hold said armatures.

2. A wire dot printer having a wire dot head comprising:

a plurality of armatures provided correspondingly to a plurality of wires and held so as to be reciprocally pivotable about a fulcrum;

an electromagnet for attracting said armatures for pivotably moving said armatures and driving said wires;

a stopper formed of a material having elasticity for stopping said armatures when they pivot for return;

shock absorbing means for alleviating the shock with which said armatures strike against said stopper, said shock absorbing means formed of a material having a greater specific gravity than that of the material of said stopper, and said shock absorbing means being resiliently urged by a spring member toward said stopper;

holding means for pivotably holding said plurality of armatures, said holding means being urged by said spring member to hold said armatures; and a second spring member provided between said shock absorbing means and said holding means to fully utilize an elastic force thereof, the force to said spring member being transmitted to said holding means through said second spring member.

3. A wire dot printer having a wire dot head comprising:

a plurality of armatures provided correspondingly to a plurality of wires and held so as to be reciprocally pivotable about a fulcrum;

an electromagnet for attracting said armatures for pivotably moving said armatures and driving said wires;

a stopper formed of a material having elasticity for stopping said armatures when they pivot for return;

shock absorbing means for alleviating the shock with which said armatures strike against said stopper, said shock absorbing means formed of a material having a greater specific gravity than that of the material of said stopper, and said shock absorbing means being resiliently urged by a spring member toward said stopper; and another spring member for also urging against said shock absorbing means, said shock absorbing means being sandwiched between said spring member and said another spring member.

* * * * *

UNITED STATES PATENT AND TRADEMARK OFFICE

CERTIFICATE OF CORRECTION

PATENT NO. : 4,697,939

DATED : October 6, 1987

INVENTOR(S) : YOJI ARA

It is certified that error appears in the above-identified patent and that said Letters Patent is hereby corrected as shown below:

COLUMN 2

Line 31, "view-taken" should read --view taken--.

COLUMN 3

Line 20, "is" should read --in--.

COLUMN 4

Line 16, "lengthwisely" should read --lengthwise--.

Line 31, "guide" should read --guides--.

COLUMN 5

Line 16, "by" should read --a--.

COLUMN 6

Line 15, "ξ" should read --ζ--.

Line 29, "ξ" should read --ζ--.

COLUMN 7

Line 10, "restore" should read --restore to--.

Line 20, "wire" should read --wire,--.

Line 21, "the" (second occurrence) should be deleted.

UNITED STATES PATENT AND TRADEMARK OFFICE

CERTIFICATE OF CORRECTION

PATENT NO. : 4,697,939

DATED : October 6, 1987

INVENTOR(S) : YOJI ARA

It is certified that error appears in the above-identified patent and that said Letters Patent is hereby corrected as shown below:

COLUMN 8

Line 6, "polyurethance" should read --polyurethane--.

Line 65, "stopper," should read --said stopper,--.

Signed and Sealed this

Thirtieth Day of August, 1988

*Attest:*

DONALD J. QUIGG

*Attesting Officer*

*Commissioner of Patents and Trademarks*